US012624419B2

(12) United States Patent
Mitsunobu et al.

(10) Patent No.: US 12,624,419 B2
(45) Date of Patent: May 12, 2026

(54) PLATED STEEL SHEET

(71) Applicant: NIPPON STEEL CORPORATION, Tokyo (JP)

(72) Inventors: Takuya Mitsunobu, Tokyo (JP); Masaaki Uranaka, Tokyo (JP); Kotaro Ishii, Tokyo (JP); Kohei Tokuda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 19/100,438

(22) PCT Filed: Jun. 7, 2023

(86) PCT No.: PCT/JP2023/021203
§ 371 (c)(1),
(2) Date: Jan. 31, 2025

(87) PCT Pub. No.: WO2024/038664
PCT Pub. Date: Feb. 22, 2024

(65) Prior Publication Data

US 2025/0257427 A1 Aug. 14, 2025

(30) Foreign Application Priority Data

Aug. 18, 2022 (JP) ..... 2022-130521

(51) Int. Cl.
*C22C 18/04* (2006.01)
*C23C 2/00* (2006.01)
(Continued)

(52) U.S. Cl.
CPC ..... *C22C 18/04* (2013.01); *C23C 2/06* (2013.01); *C23C 2/40* (2013.01); *C23C 2/52* (2022.08)

(58) Field of Classification Search
None
See application file for complete search history.

(56) References Cited

U.S. PATENT DOCUMENTS

2015/0136741 A1* 5/2015 Hosomi ..... C22C 18/04 219/74
2019/0390303 A1 12/2019 Tokuda et al.
(Continued)

FOREIGN PATENT DOCUMENTS

JP 2016-166414 A 9/2016
JP 2022-513989 A 2/2022
(Continued)

OTHER PUBLICATIONS

Written Opinion of the International Searching Authority for PCT/JP2023/021203 (PCT/ISA/237) mailed on Aug. 29, 2023.

*Primary Examiner* — Sally A Merkling
(74) *Attorney, Agent, or Firm* — Birch, Stewart, Kolasch & Birch, LLP

(57) ABSTRACT

The plated steel sheet comprises: a steel sheet; and a plated layer arranged on a surface of the steel sheet, wherein the plated layer comprises, as a chemical composition, Al: 10.0% to 25.0%, Mg: 3.0% to 10.0%, Fe: 0.01% to 2.00%, Si: more than 0.00% and 2.00% or less, and a remainder comprising Zn and impurities, and when the plated layer is subjected to grazing incidence X-ray diffraction measurement under conditions where Cu-Kα ray is used, an acceleration voltage as an X-ray output is 50 kV, and an X-ray incident angle against a surface of the plated layer is 1°, an X-ray diffraction intensity ratio between a (300) plane of a $Mg_{21}Zn_{25}$ phase and a (002) plane of an η-Zn phase (I ($Mg_{21}Zn_{25}$)/I (η-Zn)) is more than 0.3.

8 Claims, 1 Drawing Sheet

(51) Int. Cl.
*C23C 2/06* (2006.01)
*C23C 2/40* (2006.01)

(56) References Cited

U.S. PATENT DOCUMENTS

2020/0002798 A1* 1/2020 Tokuda ..... C23C 2/40
2022/0074041 A1 3/2022 Yang et al.

FOREIGN PATENT DOCUMENTS

WO WO 2018/139619 A1 8/2018
WO WO 2018/139620 A1 8/2018

* cited by examiner

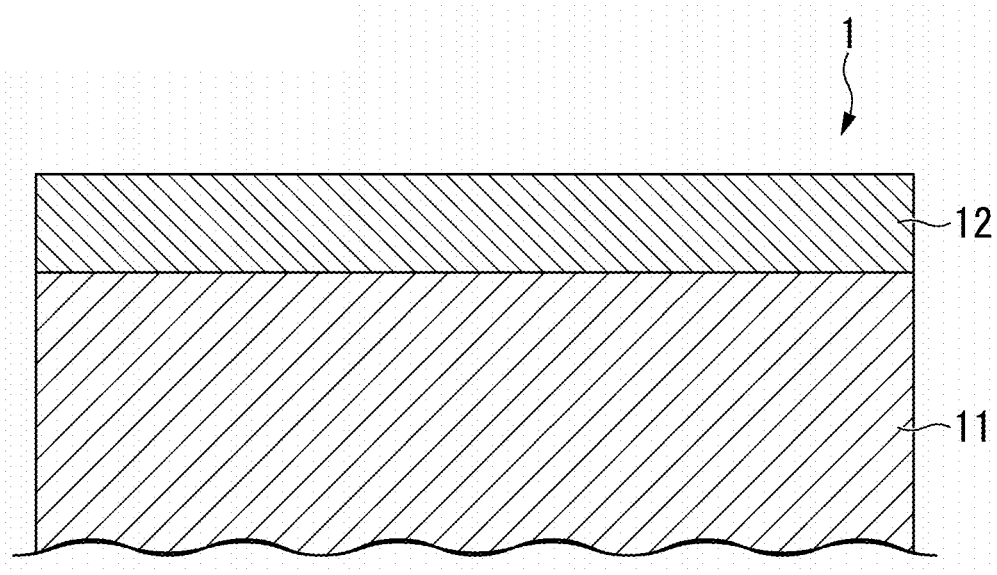
1
12
11

PLATED STEEL SHEET

TECHNICAL FIELD

The present invention relates to a plated steel sheet.

Priority is claimed on Japanese Patent Application No. 2022-130521, filed Aug. 18, 2022, the content of which is incorporated herein by reference.

BACKGROUND ART

A Zn—Al—Mg-based hot-dip plated steel sheet having a hot-dip Zn-plated layer containing Al and Mg has excellent corrosion resistance. Therefore, Zn—Al—Mg-based hot-dip plated steel sheets are widely used, for example, as a material for structural members required to have corrosion resistance, such as building materials.

For example, Patent Document 1 describes a plated steel material including a steel material and a plated layer including a Zn—Al—Mg alloy layer disposed on a surface of the steel material, in which the Zn—Al—Mg alloy layer has a Zn phase and contains a Mg—Sn intermetallic compound phase in the Zn phase, the plated layer includes, in mass %, Zn: more than 65.0%, Al: more than 5.0% to less than 25.0%, Mg: more than 3.0% to less than 12.5%, Sn: 0.1% to 20.0%, and impurities, and has a chemical composition satisfying the following formulas 1 to 5.

$$Bi + In < Sn \quad \text{Formula 1}$$

$$Y + La + Ce \leq Ca \quad \text{Formula 2}$$

$$Si < Sn \quad \text{Formula 3}$$

$$O \leq Cr + Ti + Ni + Co + V + Nb + Cu + Mn < 0.25 \quad \text{Formula 4}$$

$$O \leq Sr + Sb + Pb + B < 0.5 \quad \text{Formula 5}$$

Patent Document 2 discloses a plated steel material including a steel material and a plated layer disposed on a surface of the steel material and including a Zn—Al—Mg alloy layer, in which in a cross section of the Zn—Al—Mg alloy layer, an area fraction of a $MgZn_2$ phase is 45 to 75%, an area fraction of a total of the $MgZn_2$ phase and an Al phase is 70% or more, and an area fraction of a Zn—Al—$MgZn_2$ ternary eutectic structure is 0% to 5%, the plated layer includes, in mass %, Zn: more than 44.90% to less than 79.90%, Al: more than 15% to less than 35%, Mg: more than 5% to less than 20%, Ca: 0.1% to less than 3.0%, and impurities, and in a case where an element group A is Y, La, and Ce, an element group B is Cr, Ti, Ni, Co, V, Nb, Cu, and Mn, an element group C is Sr, Sb, and Pb, and an element group D is Sn, Bi, and In, the plated layer has a chemical composition in which a total content of elements selected from the element group A is 0% to 0.5%, a total content of Ca and the elements selected from the element group A is 0.1% to less than 3.0%, a total content of elements selected from the element group B is 0% to 0.25%, a total content of elements selected from the element group C is 0% to 0.5%, and a total content of elements selected from the element group D is 0% to 20.00%.

Patent Document 3 describes a hot-dip Al—Zn—Mg—Si plated steel sheet including a plating film on a sheet surface, in which the plating film includes an interface alloy layer present at an interface with a base steel sheet and a main layer present on the alloy layer, the plating film contains 25 to 80 mass % of Al, more than 0.6 to 15 mass % of Si, and more than 0.1 to 25 mass % of Mg, and the area fraction of $Mg_2Si$ on the surface of the main layer is 10% or more.

In recent years, hot-dip plated steel materials for building materials used for roofs, wall materials, and the like are required to be excellent in both surface corrosion resistance, which is the corrosion resistance of the plated layer itself, and cut edge corrosion resistance, which is the corrosion resistance of a cut end surface portion. On the other hand, a technique for achieving both surface corrosion resistance and cut edge corrosion resistance at a high level has not been studied.

CITATION LIST

Patent Document

Patent Document 1: PCT International Publication No. WO 2018/139619

Patent Document 2: PCT International Publication No. WO 2018/139620

Patent Document 3: Japanese Unexamined Patent Application, First Publication No. 2016-166414

SUMMARY OF INVENTION

Technical Problem

The present invention has been made in view of the above circumstances, and an object of the present invention is to provide a plated steel sheet which is excellent in both surface corrosion resistance and cut edge corrosion resistance.

Solution to Problem

In order to solve the above problem, the present invention employs the following configurations.

[1]A plated steel sheet including: a steel sheet; and a plated layer arranged on a surface of the steel sheet, wherein the plated layer includes, as a chemical composition, in terms of mass %, Al: 10.0% to 25.0%, Mg: 3.0% to 10.0%, Fe: 0.01% to 2.00%, Si: more than 0.00% and 2.00% or less, at least one selected from a group consisting of following group A, group B, and group C, and a remainder consisting of Zn and impurities, and when the plated layer is subjected to grazing incidence X-ray diffraction measurement under conditions where Cu-Kα ray is used, an acceleration voltage as an X-ray output is 50 kV, and an X-ray incident angle against a surface of the plated layer is 1°, an X-ray diffraction intensity ratio between a (300) plane of a $Mg_{21}Zn_{25}$ phase and a (002) plane of an η-Zn phase ($I(Mg_{21}Zn_{25})/I(\eta\text{-Zn})$) is more than 0.3, herein,

[Group A] Ni: 0% to 1.000%,

[Group B] Ca: 0% to 0.05%, and

[Group C] 0% to 5.000% in total of at least one of

Sb: 0% to 0.50%,

Pb: 0% to 0.50%,

Cu: 0% to 1.00%,

Sn: 0% to 1.00%,

Ti: 0% to 1.00%,

Cr: 0% to 1.00%,

Nb: 0% to 1.00%,

Zr: 0% to 1.00%,

Mn: 0% to 1.00%,
Mo: 0% to 1.00%,
Ag: 0% to 1.00%,
Li: 0% to 1.00%,
La: 0% to 0.50%,
Ce: 0% to 0.50%,
B: 0% to 0.50%,
Y: 0% to 0.50%,
P: 0% to 0.50%,
Sr: 0% to 0.50%,
Co: 0% to 0.500%,
Bi: 0% to 0.500%.
In: 0% to 0.500%,
V: 0% to 0.500%, and
W: 0% to 0.500%.

[2] The plated steel sheet according to [1], wherein
the plated layer includes, as the chemical composition, in terms of mass %,
Mg: 4.5% or more, and
the X-ray diffraction intensity ratio (I ($Mg_{21}Zn_{25}$)/I (η-Zn)) is 1.0 or more.

[3] The plated steel sheet according to [1], wherein
the plated layer includes, as the chemical composition, in terms of mass %,
Mg: 4.5% or more, and
the X-ray diffraction intensity ratio (I ($Mg_{21}Zn_{25}$)/I (η-Zn)) is 5.0 or more.

[4] The plated steel sheet according to [1], wherein
the plated layer includes, as the chemical composition, in terms of mass %,
Mg: 4.5% or more, and
the X-ray diffraction intensity ratio (I ($Mg_{21}Zn_{25}$)/I (η-Zn)) is 10.0 or more.

[5] The plated steel sheet according to any one of [1] to [4], wherein
the plated layer includes, as the chemical composition, in terms of mass %,
Sn: 0.05% to 0.5%, and
when the plated layer is subjected to X-ray diffraction measurement through θ-2θ method, a $Mg_2Sn$ phase is detected in the plated layer.

[6] The plated steel sheet according to any one of [1] to [4], wherein the plated layer includes, as the chemical composition, the group A.

[7] The plated steel sheet according to any one of [1] to [4], wherein the plated layer includes, as the chemical composition, the group B.

[8] The plated steel sheet according to any one of [1] to [4], wherein the plated layer includes, as the chemical composition, the group C.

Advantageous Effects of Invention

According to the present invention, it is possible to provide a plated steel sheet which is excellent in both surface corrosion resistance and cut edge corrosion resistance.

BRIEF DESCRIPTION OF DRAWING

FIG. 1 A schematic cross-sectional view of the hot-dip plated steel material according to an embodiment of the present invention.

DESCRIPTION OF EMBODIMENTS

By cutting the plated steel sheet, the end surface of the steel sheet is exposed at the cut end surface of the plated steel sheet. The corrosion resistance of the end surface (hereinafter, referred to as cut edge corrosion resistance) of the steel sheet is generally achieved as follows. That is, a plated layer containing an element having a higher ionization tendency than that of the base metal (for example, Zn, Mg, or the like) is formed as a plated layer on the sheet surface, the plated layer is preferentially corroded compared to the base metal to produce a corrosion product, and the corrosion product successfully prevents the corrosion of the end surface of the sheet surface. Therefore, improvement in cut edge corrosion resistance by the plated layer and improvement in surface corrosion resistance, which is the corrosion resistance of the plated layer itself, are not compatible.

Therefore, the present inventors have conducted intensive studies in order to improve both the surface corrosion resistance and cut edge corrosion resistance of a plated layer containing Al and Mg. In a plated layer containing Al, Mg, Si, and Zn, various Mg—Zn compounds containing Mg and Zn are formed. Among such Mg—Zn compounds, $Mg_{21}Zn_{25}$ contains a relatively large amount of Mg, which can contribute to the corrosion resistance of a steel sheet end surface. The present inventors have further studied the $Mg_{21}Zn_{25}$, and have found that, when the production conditions of the plated layer are adjusted, a large amount of $Mg_{21}Zn_{25}$ can be crystallized at the surface layer of the plated layer, and thereby the cut edge corrosion resistance can be improved. The presence of a large amount of the $Mg_{21}Zn_{25}$ phase at the surface of the plated layer causes corrosion of the $Mg_{21}Zn_{25}$ phase from the initial stage of corrosion of the plated layer. With the corrosion of the $Mg_{21}Zn_{25}$ phase, Mg ions are produced as a corrosion product, and the Mg ions prevent corrosion of the end surface of the steel sheet.

In addition, since a large amount of the $Mg_{21}Zn_{25}$ phase is present at the surface of the plated layer, the cut edge corrosion resistance can be improved due to the corrosion product of the $Mg_{21}Zn_{25}$ phase from the initial stage of corrosion, so that the cut edge corrosion resistance can be improved without sacrificing the surface corrosion resistance of the plated layer. Thereby both the surface corrosion resistance of the plated layer and the cut edge corrosion resistance are achieved.

Hereinafter, the plated steel sheet according to an embodiment of the present invention will be described.

In the embodiment, the plated steel sheet includes: a steel sheet; and a plated layer arranged on a surface of the steel sheet, wherein the plated layer includes, as a chemical composition, in terms of mass %, Al: 10.0% to 25.0%, Mg: 3.0% to 10.0%, Fe: 0.01% to 2.00%, Si: more than 0.00% and 2.00% or less, at least one selected from a group consisting of following group A, group B, and group C, and a remainder consisting of Zn and impurities, and when the plated layer is subjected to grazing incidence X-ray diffraction measurement under conditions where Cu-Kα ray is used, an acceleration voltage as an X-ray output is 50 kV, and an X-ray incident angle against a surface of the plated layer is 10, an X-ray diffraction intensity ratio between a (300) plane of a $Mg_{21}Zn_{25}$ phase and a (002) plane of an η-Zn phase (I ($Mg_{21}Zn_{25}$)/I (η-Zn)) is more than 0.3.

[Group A] Ni: 0% to 1.000%

[Group B] Ca: 0% to 0.05%

[Group C] 0% to 5.000% in total of at least one of Sb: 0% to 0.50%, Pb: 0% to 0.50%, Cu: 0% to 1.00%, Sn: 0% to 1.00%, Ti: 0% to 1.00%, Cr: 0% to 1.00%, Nb: 0% to 1.00%, Zr: 0% to 1.00%, Mn: 0% to 1.00%, Mo: 0% to 1.00%, Ag: 0% to 1.00%, Li: 0% to 1.00%, La: 0% to 0.50%, Ce: 0% to 0.50%, B: 0% to 0.50%, Y: 0% to 0.50%, P: 0% to 0.50%, Sr: 0% to 0.50%, Co: 0% to 0.500%, Bi: 0% to 0.500%, In: 0% to 0.500%, V: 0% to 0.500%, and W: 0% to 0.500%

In the following description, the expression "%" of the content of each element in a chemical composition means "mass %". In the ranges of numerical value limitations described below with "to" interposed therebetween, the lower limit value and the upper limit value are included in the range. A numerical value indicated as "less than" or "more than" is not included in the numerical range.

The content of an element in a chemical composition may be referred to as an element concentration (for example, Zn concentration, Mg concentration, and the like). The "surface corrosion resistance" indicates a property that the plated layer (specifically, Zn—Al—Mg alloy layer) itself is less likely to corrode. The "cut edge corrosion resistance" indicates a property of suppressing corrosion of a steel sheet at a steel sheet-exposed portion (for example, a cut end surface of a plated steel sheet). The "plated layer" means a plating film produced by the so-called hot-dip plating treatment.

As illustrated in FIG. 1, a plated steel sheet 1 according to the embodiment includes a steel sheet 11. The shape of the steel sheet 11 is not particularly limited. In addition, the steel sheet 11 may be, for example, a base steel sheet formed into a steel pipe, a civil engineering and construction material (fence culvert, corrugated pipe, drain channel lid, splash preventing plate, bolt, wire mesh, guard rail, water stop wall, and the like), a home electric appliance member (a housing of an outdoor unit of an air conditioner, or the like), a vehicle component (a suspension member, or the like), or the like. The forming is, for example, various plastic working methods, such as press, roll forming, and bending.

The material of the steel sheet 11 is not particularly limited. The steel sheet 11 may be, for example, various steel sheets, such as general steel, Al-killed steel, ultra-low carbon steel, high carbon steel, various high tensile strength steels, and some high alloy steels (steels containing a reinforcing element such as Ni, Cr, and the like). The steel sheet 11 may be a hot-rolled steel sheet, a hot-rolled steel strip, a cold-rolled steel sheet, a cold-rolled steel strip, and the like described in JIS G 3302: 2010. The method of manufacturing the steel sheet (hot rolling method, pickling method, cold rolling method, etc.), specific manufacturing conditions thereof, and the like are also not particularly limited.

As will be described later, a steel sheet 11 whose surface roughness has been adjusted is used as a steel sheet to be a plating original sheet. The surface roughness of the steel sheet can be adjusted by, for example, a method in which the surface of a rolling roll or a skin pass roll is set to have a predetermined surface roughness, and the surface shape of the roll is transferred at the time of rolling or skin pass.

The plated steel sheet 1 according to the embodiment has a plated layer 12 arranged on the surface of the steel sheet 11. In the plated steel sheet 1 according to the embodiment, the plated layer 12 is mainly made of a Zn—Al—Mg alloy layer due to the chemical composition described later. In addition, in the plated steel sheet 1 according to the embodiment, the plated layer 12 may include an interfacial alloy layer containing Fe and Al as main components between the steel sheet 11 and the Zn—Al—Mg alloy layer. That is, the plated layer 12 may have a single-layer structure of the Zn—Al—Mg alloy layer or a multi-layer structure including the Zn—Al—Mg alloy layer and the interfacial alloy layer.

The plated layer according to the embodiment is made of, as the chemical composition, Zn and other alloying elements. The chemical composition of the plated layer will be described in detail below. Note that the elements the concentration of which has a lower limit of 0% are not essential for solving the problem of the plated steel sheet according to the embodiment, but are optional elements which are allowed to be included in the plated layer for the purpose of, for example, improving characteristics.

<Al: 10.0% to 25.0%>

Al contributes to improvement in surface corrosion resistance, cut edge corrosion resistance, and workability. Therefore, the Al concentration is 10.0% or more. The Al concentration may be 11.0% or more, 12.0% or more, or 15.0% or more. On the other hand, when Al is excessive, the Mg concentration and the Zn concentration relatively decrease, and cut edge corrosion resistance is deteriorated. Therefore, the Al concentration is 25.0% or less. The Al concentration may be 24.0% or less, 22.0% or less, or 20.0% or less.

<Mg: 3.0% to 10.0%>

Mg is an element essential for securing surface corrosion resistance and cut edge corrosion resistance. Therefore, the Mg concentration is 3.0% or more. The Mg concentration may be 4.0% or more, 5.0% or more, or 6.0% or more. On the other hand, when the Mg concentration is excessive, workability, particularly powdering resistance, may be deteriorated, and surface corrosion resistance may be further deteriorated. Therefore, the Mg concentration is 10.0% or less. The Mg concentration may be 8.0% or less or 7.0% or less.

<Fe: 0.01% to 2.00%>

The concentration of Fe may be 0%, but Fe may be contained in the plated layer in an amount of 0.01% or more. It has been confirmed that, when the Fe concentration is 2.00% or less, the performance of the plated layer is not adversely affected. The Fe concentration may be, for example, 0.05% or more, 0.10% or more, 0.50% or more, or 1.00% or more. The Fe concentration is 2.00% or less. The Fe concentration may be 1.80% or less or 1.50% or less. Since Fe may be mixed from the base steel sheet, the Fe concentration may be 0.05% or more.

<Si: More than 0.00% and 2.00% or Less>

Si contributes to improvement in surface corrosion resistance. Therefore, the Si concentration may be more than 0.00%, 0.01% or more, 0.02% or more, or 0.06% or more. On the other hand, when the Si concentration is excessive, surface corrosion resistance and cut edge corrosion resistance deteriorate. Therefore, the Si concentration is 2.00% or less. The Si concentration may be 1.80% or less, 1.60% or less, 1.20% or less, or 1.00% or less.

Further, the plated layer of the embodiment may contain one or more selected from a group consisting of following group A, group B, and group C.

[Group A] Ni: 0% to 1.000%

[Group B] Ca: 0% to 0.05%

[Group C] 0% to 5.000% in total of at least one of Sb: 0% to 0.50%, Pb: 0% to 0.50%, Cu: 0% to 1.00%, Sn: 0% to 1.00%, Ti: 0% to 1.00%, Cr: 0% to 1.00%, Nb: 0% to 1.00%, Zr: 0% to 1.00%, Mn: 0% to 1.00%, Mo: 0% to 1.00%, Ag: 0% to 1.00%, Li: 0% to 1.00%, La: 0% to 0.50%, Ce: 0% to 0.50%, B: 0% to 0.50%, Y: 0% to 0.50%, P: 0% to 0.50%, Sr: 0% to 0.50%, Co: 0% to 0.500%, Bi: 0% to 0.500%, In: 0% to 0.500%, V: 0% to 0.500%, and W: 0% to 0.500%

<Ni: 0% to 1.000%>

The Ni concentration as the group A may be 0%. On the other hand, Ni contributes to improvement in cut edge corrosion resistance. Therefore, the Ni concentration may be 0.050% or more, 0.080% or more, or 0.100% or more. On the other hand, when the Ni concentration is excessive, surface corrosion resistance is deteriorated. Therefore, the Ni concentration is 1.000% or less. The Ni concentration may be 0.800% or less, 0.600% or less, or 0.500% or less, 0.100% or less, or 0.010% or less.

<Ca: 0% to 0.05%>

The Ca concentration as the group B may be 0%. On the other hand, Ca is an element capable of adjusting the optimum Mg elution amount for imparting surface corrosion resistance. Therefore, the Ca concentration may be 0.005% or more or 0.01% or more. On the other hand, when the Ca concentration is excessive, surface corrosion resistance and workability are deteriorated. Therefore, the Ca concentration is 0.05% or less. The Ca concentration may be 0.04% or less.

Further, in the embodiment, the plated layer may include, as the group C, at least one element of Sb: 0% to 0.50%, Pb: 0% to 0.50%, Cu: 0% to 1.00%, Sn: 0% to 1.00%, Ti: 0% to 1.00%, Cr: 0% to 1.00%, Nb: 0% to 1.00%, Zr: 0% to 1.00%, Mn: 0% to 1.00%, Mo: 0% to 1.00%, Ag: 0% to 1.00%, Li: 0% to 1.00%, La: 0% to 0.50%, Ce: 0% to 0.50%, B: 0% to 0.50%, Y: 0% to 0.50%, P: 0% to 0.50%, Sr: 0% to 0.50%, Co: 0% to 0.500%, Bi: 0% to 0.500%, In: 0% to 0.500%, V: 0% to 0.500%, and W: 0% to 0.500%. The total of these elements is 0% to 5.000%. If the total exceeds 5.000%, surface corrosion resistance or cut edge corrosion resistance may be reduced.

<Sb, Pb: 0% to 0.50% Each>

The concentration of Sb and Pb may be 0%. On the other hand, Sb and Pb contribute to improvement in cut edge corrosion resistance. Therefore, the concentration of each of Sb and Pb may be 0.05% or more, 0.10% or more, or 0.15% or more. On the other hand, when the concentration of Sb and Pb is excessive, surface corrosion resistance is deteriorated. Therefore, the concentration of each of Sb and Pb is 0.50% or less. The concentration of each of Sb and Pb may be 0.40% or less, 0.30% or less, 0.25% or less, or 0.10% or less.

<Cu, Ti, Cr, Nb, Zr, Mn, Mo, Ag, and Li: 0% to 1.00% Each>

The concentration of each of Cu, Ti, Cr, Nb, Zr, Mn, Mo, Ag, and Li may be 0%. On the other hand, they contribute to improvement in cut edge corrosion resistance. Therefore, the concentration of each of Cu, Ti, Cr, Nb, Zr, Mn, Mo, Ag, and Li may be 0.05% or more, 0.08% or more, or 0.10% or more. On the other hand, when the concentration of Cu, Ti, Cr, Nb, Zr, Mn, Mo, Ag, and Li is excessive, surface corrosion resistance is deteriorated. Therefore, the concentration of each of Cu, Ti, Cr, Nb, Zr, Mn, Mo, Ag, and Li is 1.00% or less. The concentration of each of Cu, Ti, Cr, Nb, Zr, Mn, Mo, Ag, and Li may be 0.80% or less, 0.70% or less, 0.60% or less, 0.10% or less, or 0.05% or less.

<Sn: 0% to 1.00%>

The Sn concentration may be 0%. On the other hand, Sn is an element that forms an intermetallic compound with Mg and improves the cut edge corrosion resistance of the plated layer. Therefore, the Sn concentration may be 0.05% or more, 0.10% or more, or 0.20% or more. However, when the Sn concentration is excessive, surface corrosion resistance is deteriorated. Therefore, the Sn concentration is 1.00% or less. The Sn concentration may be 0.80% or less, 0.60% or less, 0.50% or less, or 0.10% or less.

<La, Ce, B, Y, P, and Sr: 0% to 0.50% Each>

The concentration of each of La, Ce, B, Y, P, and Sr may be 0%. On the other hand, La, Ce, B, Y, P, and Sr contribute to improvement in cut edge corrosion resistance. Therefore, the concentration of each of La, Ce, B, Y, P, and Sr may be 0.10% or more, 0.15% or more, or 0.20% or more. On the other hand, when the concentration of each of La, Ce, B, Y, P, and Sr is excessive, surface corrosion resistance is deteriorated. Therefore, the concentration of each of La, Ce, B, Y, P, and Sr is 0.50% or less. The concentration of each of La, Ce, B, Y. P, and Sr may be 0.40% or less, 0.30% or less, 0.10% or less, or 0.05% or less, respectively.

<Co, Bi, In, V, and W: 0% to 0.500% Each>

The concentration of each of Co, Bi, In, V, and W may be 0%. On the other hand, Co, Bi, In, V, and W contribute to improvement in cut edge corrosion resistance. Therefore, the concentration of each of Co, Bi, In, V, and W may be 0.100% or more, 0.150% or more, or 0.200% or more, respectively. On the other hand, when the concentration of each of Co, Bi, In, V, and W is excessive, surface corrosion resistance is deteriorated. Therefore, the concentration of each of Co, Bi, In, V, and W is 0.5% or less. The concentration of each of Co, Bi, In, V, and W may be 0.400% or less, 0.300% or less, 0.100% or less, 0.050% or less, or 0.010% or less, respectively.

<Remainder: Zn and Impurities>

The remainder in the components of the plated layer according to the embodiment includes Zn and impurities. Zn is an element that brings surface corrosion resistance and cut edge corrosion resistance to the plated layer. The impurity refers to a component that is contained in a raw material or mixed in a manufacturing process and not intentionally contained, or a component not adversely affecting the plated steel sheet of the embodiment. For example, in the plated layer, a small amount of components other than Fe may be mixed as the impurity due to mutual atomic diffusion between the base steel sheet and the plating bath.

The chemical composition of the plated layer is measured with the following method. First, an acid solution in which the plated layer is peeled off and dissolved is obtained using an acid containing an inhibitor that suppresses steel sheet corrosion. Next, the obtained acid solution is subjected to ICP analysis. Thereby, the chemical composition of the plated layer can be determined. The type of the acid is not particularly limited as long as the acid can dissolve the plated layer. The chemical composition measured by the above-described means is the average chemical composition of the entire plated layer.

Next, the microstructure of the plated layer will be described.

In the embodiment, at the surface layer of the plated layer, a $Mg_{21}Zn_{25}$ phase is present. The surface layer of the plated layer is exactly defined as a depth region where X-ray enters and diffracted rays are obtained in grazing incidence X-ray diffraction measurement with an X-ray incident angle of 1°. Approximately, the region ranging from the outermost surface of the plated layer to the depth of 3 μm may be employed. The $Mg_{21}Zn_{25}$ phase may be present in a region other than the surface layer of the plated layer, but is necessarily contained at the surface layer. Since the $Mg_{21}Zn_{25}$ phase is present at the surface layer of the plated layer, the $Mg_{21}Zn_{25}$ phase is corroded at the initial stage of corrosion of the plated layer to form a corrosion product, and corrosion resistance of the end surface of the steel sheet is improved by the corrosion product. Thereby, the cut edge corrosion resistance can be improved without impairing the surface corrosion resistance of the plated layer.

The presence of the $Mg_{21}Zn_{25}$ phase is confirmed by whether the $Mg_{21}Zn_{25}$ phase is detected when the plated layer is subjected to grazing incidence X-ray diffraction measurement under conditions where Cu-Kα ray is used, an acceleration voltage as an X-ray output is 50 kV, and an X-ray incident angle against the surface of the plated layer is 1°. Specifically, the presence of the $Mg_{21}Zn_{25}$ phase is confirmed by whether the diffraction peak from the (300)

plane of the $Mg_{21}Zn_{25}$ phase is present. The diffraction peak from the (300) plane of the $Mg_{21}Zn_{25}$ phase is confirmed in a diffraction angle range of 11.92±0.4°. The grazing incidence X-ray diffraction (GIXD) is a method of performing measurement where the X-ray incident angle is fixed at a small angle, which enables highly sensitive detection of an intermetallic compound contained at the surface layer of the plated layer.

For the determination on whether the $Mg_{21}Zn_{25}$ phase is detected, when the X-ray diffraction intensity ratio (I ($Mg_{21}Zn_{25}$)/I (η-Zn)) described below is more than 0.3, the $Mg_{21}Zn_{25}$ phase is present.

As described above, the $Mg_{21}Zn_{25}$ phase is present at the surface layer of the plated layer, but the $Mg_{21}Zn_{25}$ phase may be present also in a region other than the surface layer of the plated layer. That is, the $Mg_{21}Zn_{25}$ phase may be not only detected by grazing incidence X-ray diffraction measurement, but also detected by an ordinal X-ray diffraction measurement through θ-2θ method. However, when a large amount of the $Mg_{21}Zn_{25}$ phase is formed in a region other than the surface layer of the plated layer, the amount of the $Mg_{21}Zn_{25}$ phase may be reduced at the surface layer of the plated layer. Therefore, as described later, it is necessary to appropriately control the cooling conditions when the plated layer is formed.

Note that the grazing incidence X-ray diffraction measurement is also called thin film X-ray diffraction. In this method, unlike the ordinal θ-2θ measurement method, X-ray diffraction is measured by moving the X-ray detector while the X-ray incident angle is fixed against the sample.

The number density of the $Mg_{21}Zn_{25}$ phases at the surface of the plated layer may be affected by the average chemical composition of the plated layer. When the plated layer includes, as the chemical composition, in terms of mass %, 4.5% or more of Mg, and the plated layer is subjected to grazing incidence X-ray diffraction measurement under conditions where Cu-Kα ray is used, the acceleration voltage as an X-ray output is 50 kV, and the X-ray incident angle against the surface of the plated layer is 1°, the X-ray diffraction intensity ratio between the (300) plane of the $Mg_{21}Zn_{25}$ phase and the (002) plane of the t-Zn phase (I ($Mg_{21}Zn_{25}$)/I (T-Zn)) may be 1.0 or more, 5.0 or more, 10.0 or more, 15.0 or more, or 20.0 or more. When the X-ray diffraction intensity ratio (I ($Mg_{21}Zn_{25}$)/I (η-Zn)) becomes a higher value, both the surface corrosion resistance and the cut edge corrosion resistance can be achieved at a high level.

In addition, I ($Mg_{21}Zn_{25}$) is the peak intensity of the diffraction peak of the (300) plane of the $Mg_{21}Zn_{24}$ phase, and more specifically, is the maximum diffraction intensity within a diffraction angle range of 11.92±0.4°. I (η-Zn) is the peak intensity of the diffraction peak of the (002) plane of the η-Zn phase, and more specifically, is the maximum diffraction intensity within a diffraction angle range of 36.24±0.4°.

In the chemical composition of the plated layer in the embodiment, the η-Zn phase is a metal phase that is present in a relatively large amount not only at the surface layer of the plated layer but also in the entire plated layer. Therefore, it is preferable that the diffraction intensity of the η-Zn phase is a standard. It can be said that the higher the diffraction intensity ratio of the $Mg_{21}Zn_{25}$ phase to the diffraction intensity of the η-Zn phase, the more the $Mg_{21}Zn_{25}$ phase is contained at the surface layer of the plated layer. When a large amount of the $Mg_{21}Zn_{25}$ phase is contained at the surface layer of the plated layer, a corrosion product of the $Mg_{21}Zn_{25}$ phase is formed in a larger amount at the initial stage of corrosion of the plated layer, and thereby corrosion resistance of the end surface of the steel sheet is further improved.

The upper limit of I ($Mg_{21}Zn_{25}$)/I (η-Zn) is not particularly limited, and may be, for example, 50.0 or less, 45.0 or less, 40.0 or less, 35.0 or less, or 30.0 or less.

The method for measuring the diffraction intensity of the $Mg_{21}Zn_{25}$ phase and the η-Zn phase will be described. Using an X-ray diffractometer ((model number RINT1500), manufactured by Rigaku Corporation), the grazing incidence X-ray diffraction measurement is performed in the range of 2θ=5 to 90° under the conditions of X-ray output: (acceleration voltage) 50 kV, (acceleration current) 200 mA, X-ray source: copper target, X-ray irradiation angle: 1°, attachment: using a rotary sample stage for thin film, filter: none, and monochromator: use. Then, the diffraction intensity of the (300) plane of the $Mg_{21}Zn_{25}$ phase (maximum intensity in a range of 11.92±0.4°) and the diffraction intensity of the (002) plane of the η-Zn phase (maximum intensity in a range of 36.24±0.4°) are measured, respectively. The diffraction intensity is an intensity excluding the background intensity. From the obtained diffraction intensity, I ($Mg_{21}Zn_{25}$)/I (η-Zn) is obtained. When the acceleration voltage of 50 kV, the X-ray source of Cu, and the X-ray incident angle of 1° are satisfied as the measurement conditions, the detection of the $Mg_{21}Zn_{25}$ phase and the diffraction intensity ratio of the $Mg_{21}Zn_{25}$ phase and the η-Zn phase are not affected even if other measurement conditions are different.

In addition, when 0.05 to 0.5% of Sn is contained in the plated layer, a $Mg_2Sn$ phase is preferably contained in the plated layer. Since the amount of the $Mg_2Sn$ phase is small, the presence thereof is detected and confirmed by X-ray diffraction measurement through the θ-2θ method. When the plated layer contains the $Mg_2Sn$ phase therein, the plated layer has more improved cut edge corrosion resistance. When the $Mg_2Sn$ phase is detected, the X-ray diffraction measurement may be performed by the θ-2θ measurement method. When a peak is detected at 23.4±0.3° in the X-ray diffraction measurement with Kα rays from a Cu tube, it is determined that the $Mg_2Sn$ phase is present.

The adhesion amount of the plated layer per one surface may be, for example, within a range of 20 to 150 g/m$^2$. When the adhesion amount per one surface is 20 g/m$^2$ or more, surface corrosion resistance and cut edge corrosion resistance of the plated steel sheet can be further enhanced. On the other hand, when the adhesion amount per one surface is 150 g/m$^2$ or less, the workability of the plated steel sheet can be further improved.

Next, the method for manufacturing a plated steel sheet of the embodiment will be described, but the method for manufacturing a plated steel sheet according to the embodiment is not particularly limited. For example, according to the manufacturing conditions described below, the plated steel sheet according to the embodiment can be obtained.

As for the method for manufacturing the plated steel sheet of the embodiment, a steel sheet whose surface roughness has been adjusted is annealed in a reducing atmosphere, and the annealed steel sheet is immersed in a hot-dip plating bath and then pulled up to form a plated layer on the surface of the steel sheet. Subsequently, cooling is performed by spraying cooling gas until the temperature of the plated layer reaches 300° C. or lower from the bath temperature. For the gas flux of the blown cooling gas, the gas flux is in a range of 5000 to 80000 L/min/m$^2$ from the bath temperature to the controlled cooling temperature, and the gas flux is in a range of 0 to 5000 L/min/$m^2$ from the controlled cooling temperature to 300° C. or lower.

The controlled cooling temperature is a temperature within the range of −10° C. to −30° C. with respect to the crystallization temperature of the $Mg_{21}Zn_{25}$ phase.

The roughness of the surface of the steel sheet as a plating original sheet is 0.1 to 3.5 m in terms of calculated surface roughness Ra. When the roughness is out of this range, a large amount of the $Mg_{21}Zn_{25}$ phase crystallizes near the interface between the plated layer and the steel sheet, and the amount of the $Mg_{21}Zn_{25}$ phases may decrease at the surface of the plated layer. The method for adjusting the roughness of the sheet surface is not particularly limited, but the roughness may be adjusted by, for example, rolling the plating original sheet with a rolling roll or a roll for temper rolling the roll surface of which has been adjusted to a desired roughness to transfer the surface shape of the roll. Alternatively, the roughness may be adjusted by pickling.

The arithmetic mean roughness is measured using, for example, a shape measurement laser microscope (model number: VK-8700), which is manufactured by KEYENCE CORPORATION. As measurement conditions, for example, measurement is performed under the following conditions: measurement mode: laser confocal, measurement quality: high accuracy, pitch: 0.75 μm, double scan: ON, optical zoom: 1 time, objective lens name: Plan, γ coefficient: 0.45, and offset: 0%. The measuring device used for measuring the arithmetic mean roughness is not limited to the above example.

The steel sheet as a plating original sheet is annealed in a reducing atmosphere. The reducing atmosphere and the annealing conditions are not particularly limited. By this annealing, the oxide present on the sheet surface is removed as much as possible.

Subsequently, the steel sheet after annealing is immersed in a hot-dip plating bath. The chemical composition of the hot-dip plating bath may be appropriately adjusted to obtain the chemical composition of the plated layer described above. The temperature of the hot-dip plating bath is also not particularly limited. It is possible to appropriately select a temperature at which hot-dip plating can be performed. For example, the plating bath temperature may be higher than the melting point of the plating bath by about 20° C. or more.

Next, the steel sheet is pulled up from the hot-dip plating bath. The adhesion amount of the plated layer can be controlled by controlling the pulling speed of the steel sheet. If necessary, wiping may be performed on the steel sheet to which the plated layer is adhered to control the adhesion amount of the plated layer. The adhesion amount of the plated layer is not particularly limited, and can be, for example, within the above-described range.

Next, the plated layer is cooled. The cooling is performed by spraying cooling gas on the steel sheet immediately after being pulled up from the hot-dip plating bath. The cooling by spraying cooling gas is continuously performed until the temperature of the steel sheet reaches 300° C. from the bath temperature. The cooling condition at less than 300° C. is not particularly limited, but cooling may be performed by subsequently spraying cooling gas, or by natural air cooling.

In the cooling by spraying cooling gas, a cooling zone is arranged along the conveyance path for the steel sheet. The cooling zone includes a plurality of spraying nozzles for cooling gas. The shape of the gas nozzle from which the cooling gas is blown out is, for example, in the range of a diameter of 1 to 50 mm. The angle formed by the tip of the gas nozzle and the steel sheet is, for example, in the range of 70 to 110°, more preferably 90° (perpendicular). The distance between the tip of the gas nozzle and the steel sheet is in the range of 30 to 1000 mm. The shape, angle, and distance of the gas nozzle are merely examples, and are not limited to the above ranges.

The cooling gas to be sprayed is not particularly limited, and may be a non-oxidizing gas such as nitrogen, an inert gas such as argon, or air, or a mixed gas thereof.

In the embodiment, the gas flux of the sprayed cooling gas is controlled in two stages. That is, on the basis of the temperature of the steel sheet, the gas flux is in a range of 5000 to 80000 L/min/$m^2$ from the plating bath temperature to the controlled cooling temperature (the temperature in the range of −10° C. to −30° C. with respect to the crystallization temperature of the $Mg_{21}Zn_{25}$ phase), and the gas flux is in a range of 0 to 5000 L/min/$m^2$ from the controlled cooling temperature to 300° C. or lower. The controlled cooling temperature is a temperature assumed to be the crystallization start temperature of the $Mg_{21}Zn_{25}$ phase.

The gas flux can be adjusted by changing the shape of the gas nozzle, controlling the output of the compressor, or the like.

When the gas flux is in the range of less than 5000 L/min/$m^2$, the surface of the plated layer can be prevented from vibration during cooling. On the other hand, when the gas flux is in the range of 5000 L/min/$m^2$ or more, minute vibration can be applied to the surface of the plated layer during cooling.

When the gas flux is in a range of 5000 to 80000 L/min/$m^2$ from the plating bath temperature to the controlled cooling temperature, vibration is applied to the surface of the plated layer to promote nucleation of the $Mg_{21}Zn_{25}$ phase at the surface of the plated layer. Next, when the gas flux is in a range of 0 to 5000 L/min/$m^2$ from the controlled cooling temperature to 300° C. or lower, the $Mg_{21}Zn_{25}$ phase nucleated at the surface is further grown. When the range of the gas flux is out of the above range, it becomes difficult to crystallize the $Mg_{21}Zn_{25}$ phase at the surface of the plated layer.

It is preferable that the gas flux from the controlled cooling temperature to 300° C. or lower is lower than the gas flux from the plating bath temperature to the controlled cooling temperature. When the gas flux is constant between both of the temperature regions (When the gas flux is 5000 Imin/$m^2$ from the plating bath temperature to the controlled cooling temperature and the gas flux is 5000 L/min/$m^2$ from the controlled cooling temperature to 300° C. or lower), the average cooling rate preferably differs between both of the temperature ranges. Under such conditions, the $Mg_{21}Zn_{25}$ phase can be preferably generated at the surface layer of the plated layer.

Since the crystallization temperature of the $Mg_{21}Zn_{25}$ phase varies depending on the chemical composition of the plating bath, the crystallization temperature is calculated using a calculation phase diagram. Specifically, the crystallization temperature of the $Mg_{21}Zn_{25}$ phase is determined for each chemical composition of the plating bath by constructing a calculation phase diagram database in which thermodynamic data of intermetallic compound phases, metal phases, and the like that can be contained in the Al—Mg—Zn based alloy are integrated, and performing calculation by CALPHAD method (CALculation of PHAse Diagram). More specifically, the crystallization temperature of the $Mg_{21}Zn_{25}$ phase can be estimated by using a thermodynamic equilibrium calculation software, "Thermo-Calc" ((Thermo-Calc is a registered trademark), manufactured by Thermo-Calc Software). The thermodynamic equilibrium calculation software used for the calculation is not limited to "Thermo-Calc" (registered trademark), and other software may be used. The temperature within the range of −10° C. to −30° C. with respect to the obtained crystallization temperature of the $Mg_{21}Zn_{25}$ phase is defined as the controlled cooling temperature.

In the above manufacturing method, nucleation of the $Mg_{21}Zn_{25}$ phase is suppressed in the vicinity of the interface between the steel sheet and the plated layer by adjusting the surface roughness of the sheet surface in advance, whereby the crystallization of the $Mg_{21}Zn_{25}$ phase is suppressed in the vicinity of the interface between the plated layer and the steel sheet. By performing hot-dip plating on such a steel sheet and controlling the cooling conditions after plating as described above, a large amount of the $Mg_{21}Zn_{25}$ phase is crystallized at the surface of the plated layer. As a result, it is assumed that a large number of the $Mg_{21}Zn_{25}$ phases can be formed at the surface of the plated layer.

As long as the requirements shown in the present invention are satisfied, the method for manufacturing a plated steel sheet is not limited to the above contents, and instead of the hot-dip plating method, an electro plating method, a vapor deposition plating method, a thermal spraying method, a cold spraying method, or the like may be adopted.

EXAMPLES

Hereinafter, examples of the present invention will be described. However, the conditions in examples are merely one condition example adopted to confirm the operability and effects of the present invention. The present invention is not limited to this one condition example. The present invention can adopt various conditions as long as the object of the present invention is achieved without departing from the gist of the present invention.

A cold-rolled steel sheet (0.05 C-0.1 Si—0.2 Mn) having a sheet thickness of 2.3 mm was used as a plating original sheet. The surface roughness of a part of the plating original sheet was controlled using a skin pass mill or the like. The steel sheet whose surface roughness had been adjusted was annealed. The annealed steel sheet was immersed in various hot-dip plating baths and then pulled up to adhere a plated layer to the sheet surface. Subsequently, various plated steel sheets were manufactured by cooling the plated layer using cooling gas immediately after being pulled up from the plating bath until the temperature of the plated layer reached 300° C.

The arithmetical mean roughness Ra of the surface of the steel sheet as a plating original sheet was as shown in the table.

The arithmetic mean roughness was measured using a shape measurement laser microscope (model number: VK-8700), which is manufactured by KEYENCE CORPORATION. As the measurement conditions, measurement was performed under the following conditions: measurement mode: laser confocal, measurement quality: high accuracy, pitch: 0.75 μm, double scan: ON, optical zoom: 1 time, objective lens name: Plan, γ coefficient: 0.45, and offset: 0%.

The steel sheet was annealed in a reducing atmosphere in annealing conditions of a soaking temperature of 600° C. and a soaking time of 10 seconds. The annealing atmosphere was a reducing atmosphere made of a mixed gas of 5% hydrogen and remainder nitrogen. Then, the annealed steel sheet was air-cooled with a nitrogen gas, and after the temperature of the immersion sheet reached the bath temperature +20° C., the steel sheet was immersed in a hot-dip plating bath and then pulled up. The pulling speed was set to 20 to 200 mm/sec.

The chemical composition of the plated layer was as shown in Table 1. The manufacturing conditions were as shown in Table 2. Also, the microstructure of the plated layer was evaluated, and the results are shown in Table 3. Furthermore, the surface corrosion resistance and the cut edge corrosion resistance of the plated steel sheet were evaluated, and the results are shown in Table 3.

The chemical composition of the plated layer and the microstructure of the plated layer were evaluated by the means described above.

The surface corrosion resistance was evaluated as follows. The obtained hot-dip plated steel material was cut into 100 mm×50 mm and subjected to an evaluation test of surface corrosion resistance. The surface corrosion resistance was evaluated by the corrosion acceleration test specified in JASO-CCT-M609. After 90 cycles, the corrosion loss was compared. The evaluation criteria were as follows, and "AAA", "AA", and "A" were regarded as acceptable.

AAA: Corrosion loss of less than 30 g/m$^2$

AA: Corrosion loss of 30 g/m$^2$ or more and less than 60 g/m$^2$

A: Corrosion loss of 60 g/m$^2$ or more and less than 90 g/m$^2$

B: Corrosion loss of 90 g/m$^2$ or more

The cut edge corrosion resistance was evaluated as follows. The obtained hot-dip plated steel material was cut into a size of 50 mm×50 mm to obtain a quadrangular test piece. Then, in the region centering the intersection point of the diagonal lines of the test piece and having a diameter of 15 mm, the plated layer was removed by milling to form a region where the steel sheet (base metal) was exposed. The region with a diameter of 15 mm where the base metal was exposed was subjected to the neutral salt spray test specified in JIS Z 2371: 2015, and the red rust generation state was evaluated in the region where the base metal was exposed. The evaluation criteria of the red rust area ratio are shown below. "AAA", "AA", and "A" were regarded as acceptable.

AAA: Red rust area ratio of 10% or less in 1300 h

AA: Red rust area ratio of 10% or less in 800 h

A: Red rust area ratio of 20% or less in 400 h

B: Red rust area ratio of more than 20% in 400 h

As shown in Tables 1 to 3, Examples 1 to 27 according to the present invention, in which the chemical composition and the microstructure of the plated layer were appropriately controlled, were excellent in both surface corrosion resistance and cut edge corrosion resistance. In examples, the adhesion amount of the plated layer per one surface was within a range of 20 to 150 g/m$^2$.

Comparative Example 28 had an insufficient Al amount in the plated layer. Therefore, Comparative Example 28 had an insufficient surface corrosion resistance.

Comparative Example 29 had an excessive Al amount in the plated layer. Therefore, in Comparative Example 29, the $Mg_{21}Zn_{25}$ phase crystallized, but the cut edge corrosion resistance was deteriorated.

Comparative Example 30 had an insufficient Mg amount in the plated layer. Therefore, in Comparative Example 30, Mg was insufficient, so that the $Mg_{21}Zn_{25}$ phase was not crystallized, and surface corrosion resistance and cut edge corrosion resistance were deteriorated.

Comparative Example 31 had an excessive Mg amount in the plated layer. Therefore, in Comparative Example 31, a Mg—Zn phase having a lower electric potential was excessively generated, and surface corrosion resistance was deteriorated.

In Comparative Example 32, the cooling gas flux was insufficient from the bath temperature to the controlled cooling temperature. Therefore, in Comparative Example 32, the $Mg_{21}Zn_{25}$ phase could not crystallize, and the cut edge corrosion resistance was reduced.

In Comparative Example 33, the cooling gas flux was excessive from the controlled cooling temperature to 300° C. Therefore, in Comparative Example 33, a large amount of the $Mg_{21}Zn_{25}$ phase crystallized inside the plated layer, the $Mg_{21}Zn_{25}$ phase did not crystallize at the surface layer of the plated layer, and the cut edge corrosion resistance was reduced.

In Comparative Example 34, the arithmetical mean roughness Ra of the surface of the steel sheet as a plating original sheet was out of the preferable range. Therefore, a large amount of the $Mg_{21}Zn_{25}$ phase crystallized near the interface between the plated layer and the steel sheet, the amount of the $Mg_{21}Zn_{25}$ phase decreased at the surface of the plated layer, and the cut edge corrosion resistance decreased.

In Comparative Example 35, the cooling gas flux was excessive from the controlled cooling temperature to 300° C. Therefore, in Comparative Example 35, the $Mg_{21}Zn_{25}$ phase was not crystallized at the surface layer of the plated layer, and the cut edge corrosion resistance was reduced.

Comparative Example 36 had an excessive Al amount in the plated layer. Therefore, in Comparative Example 29, the $Mg_{21}Zn_{25}$ phase was not crystallized at the surface layer of the plated layer, and the cut edge corrosion resistance was reduced.

TABLE 1

| | | Chemical composition of plated layer (mass %) Remainder: Zn and impurities | | | | | | | | |
|---|---|---|---|---|---|---|---|---|---|---|
| | | | | | | | | | Other elements | |
| Classification | No. | Al | Mg | Sn | Si | Ca | Ni | Fe | Type | Total (mass %) |
| Example | 1 | 10.0 | 3.0 | | 0.01 | | | 0.05 | — | — |
| Example | 2 | 11.0 | 3.0 | 0.06 | 0.10 | | | 0.05 | Co | 0.006 |
| Example | 3 | 10.0 | 4.5 | | 0.01 | 0.04 | | 0.05 | Bi | 0.004 |
| Example | 4 | 10.0 | 5.0 | | 0.01 | | | 0.08 | V | 0.008 |
| Example | 5 | 12.0 | 5.0 | | 0.01 | | | 0.08 | Pb | 0.03 |
| Example | 6 | 12.0 | 6.0 | | 0.10 | | | 0.10 | Sr | 0.05 |
| Example | 7 | 12.0 | 6.0 | | 0.10 | | | 0.08 | — | — |
| Example | 8 | 13.0 | 5.0 | | 0.20 | | | 0.10 | Li | 0.02 |
| Example | 9 | 15.0 | 5.0 | 0.06 | 0.20 | | | 0.20 | Ag | 0.01 |
| Example | 10 | 17.0 | 5.0 | | 0.20 | 0.04 | 0.001 | 0.20 | P | 0.01 |
| Example | 11 | 18.0 | 6.0 | | 0.40 | 0.04 | | 0.20 | Mn | 0.02 |
| Example | 12 | 19.0 | 6.0 | 0.20 | 0.60 | 0.04 | | 0.10 | Sb | 0.08 |
| Example | 13 | 19.0 | 6.0 | | 0.20 | 0.04 | | 0.10 | In | 0.020 |
| Example | 14 | 19.0 | 7.0 | | 0.20 | 0.04 | | 0.30 | — | — |
| Example | 15 | 20.0 | 10.0 | | 0.20 | 0.05 | | 0.10 | B | 0.01 |
| Example | 16 | 20.0 | 6.0 | | 0.10 | 0.04 | | 0.10 | Nb | 0.01 |
| Example | 17 | 20.0 | 3.0 | | 0.20 | 0.04 | | 0.30 | — | — |
| Example | 18 | 22.0 | 6.0 | | 0.40 | 0.04 | | 0.10 | La | 0.02 |
| Example | 19 | 22.0 | 8.0 | | 0.70 | 0.04 | | 0.20 | Ce | 0.02 |
| Example | 20 | 22.0 | 4.0 | | 0.10 | 0.01 | | 0.20 | Zr | 0.01 |
| Example | 21 | 24.0 | 3.0 | | 0.10 | | | 0.30 | W | 0.020 |
| Example | 22 | 22.0 | 4.0 | | 0.10 | 0.01 | 0.010 | 0.40 | Mo | 0.03 |
| Example | 23 | 23.0 | 8.0 | | 0.70 | 0.04 | | 0.60 | Ti | 0.01 |
| Example | 24 | 23.0 | 8.0 | | 0.70 | 0.04 | | 0.60 | Ti | 0.01 |
| Example | 25 | 25.0 | 8.0 | | 1.20 | 0.04 | | 1.00 | Cu | 0.20 |
| Example | 26 | 24.0 | 7.0 | | 1.60 | 0.04 | | 1.40 | Y | 0.02 |
| Example | 27 | 25.0 | 8.0 | | 2.00 | 0.04 | | 1.30 | Cr | 0.05 |
| Comparative Example | 28 | 8.0 | 4.0 | | 0.00 | | | 0.10 | — | — |
| Comparative Example | 29 | 26.0 | 7.0 | | 0.10 | | | 0.10 | — | — |
| Comparative Example | 30 | 19.0 | 2.5 | | 0.20 | 0.01 | | 0.10 | — | — |
| Comparative Example | 31 | 19.0 | 11.0 | | 0.00 | 0.05 | | 0.10 | — | — |
| Comparative Example | 32 | 15.0 | 3.0 | | 0.00 | 0.01 | | 0.80 | — | — |
| Comparative Example | 33 | 15.0 | 3.0 | | 0.00 | 0.01 | | 0.80 | — | — |
| Comparative Example | 34 | 15.0 | 3.0 | | 0.00 | | | 0.90 | — | — |
| Comparative Example | 35 | 15.0 | 4.0 | | 0.00 | | | 0.80 | — | — |
| Comparative Example | 36 | 40.5 | 7.0 | | 0.30 | 0.10 | | 0.10 | — | — |

The underlines mean that the value is out of the scope of the present invention.

TABLE 2

| Classification | No. | Manufacturing conditions: Roughness of sheet surface Ra (μm) | Bath temperature (° C.) | Controlled cooling temperature (° C.) | Cooling gas flux from bath temperature to controlled cooling temperature (L/min/m$^2$) | Average cooling rate from bath temperature to controlled cooling temperature (° C./s) | Cooling gas flux from controlled cooling temperature to 300° C. (L/min/m$^2$) | Average cooling rate from controlled cooling temperature to 300° C. (° C./s) |
|---|---|---|---|---|---|---|---|---|
| Example | 1 | 1.1 | 460 | 400 | 5000 | 15 | 2000 | 7 |
| Example | 2 | 1.4 | 480 | 420 | 5000 | 15 | 4900 | 13 |
| Example | 3 | 1.5 | 500 | 440 | 5000 | 15 | 0 (air cooling) | 2 |
| Example | 4 | 1.3 | 500 | 440 | 10000 | 15 | 4900 | 8 |
| Example | 5 | 1.2 | 530 | 470 | 10000 | 15 | 4900 | 8 |
| Example | 6 | 0.8 | 530 | 470 | 10000 | 15 | 4900 | 8 |
| Example | 7 | 1.4 | 530 | 470 | 10000 | 15 | 4900 | 8 |
| Example | 8 | 1.1 | 530 | 470 | 10000 | 15 | 4900 | 8 |
| Example | 9 | 1.4 | 530 | 470 | 10000 | 15 | 4900 | 8 |
| Example | 10 | 1.2 | 530 | 470 | 10000 | 15 | 4900 | 8 |
| Example | 11 | 1.3 | 530 | 470 | 5000 | 15 | 4900 | 8 |
| Example | 12 | 1.6 | 530 | 470 | 5000 | 15 | 4900 | 8 |
| Example | 13 | 1.3 | 530 | 470 | 10000 | 15 | 4900 | 8 |
| Example | 14 | 1.5 | 530 | 470 | 10000 | 15 | 4900 | 8 |
| Example | 15 | 2.9 | 590 | 530 | 10000 | 15 | 4900 | 8 |
| Example | 16 | 1.1 | 540 | 480 | 10000 | 15 | 4900 | 8 |
| Example | 17 | 3.5 | 540 | 480 | 10000 | 20 | 4900 | 8 |
| Example | 18 | 1.1 | 540 | 480 | 10000 | 20 | 4900 | 8 |
| Example | 19 | 0.9 | 540 | 480 | 10000 | 20 | 4900 | 8 |
| Example | 20 | 2.2 | 540 | 480 | 5000 | 20 | 4900 | 8 |
| Example | 21 | 2.7 | 560 | 500 | 5000 | 20 | 4900 | 8 |
| Example | 22 | 2.1 | 540 | 480 | 5000 | 20 | 4900 | 8 |
| Example | 23 | 1.5 | 550 | 490 | 10000 | 20 | 4900 | 8 |
| Example | 24 | 1.2 | 550 | 490 | 80000 | 20 | 4900 | 8 |
| Example | 25 | 1.6 | 550 | 490 | 10000 | 20 | 4900 | 8 |
| Example | 26 | 0.4 | 550 | 490 | 10000 | 20 | 4900 | 8 |
| Example | 27 | 0.9 | 550 | 490 | 10000 | 20 | 4900 | 8 |
| Comparative Example | 28 | 3.2 | 450 | 370 | 5000 | 15 | 4900 | 10 |
| Comparative Example | 29 | 2.9 | 600 | 520 | 5000 | 15 | 4900 | 10 |
| Comparative Example | 30 | 3.4 | 540 | 460 | 5000 | 15 | 4900 | 10 |
| Comparative Example | 31 | 3.5 | 540 | 460 | 5000 | 15 | 4900 | 10 |
| Comparative Example | 32 | 3.2 | 520 | 440 | 4000 | 15 | 4900 | 10 |
| Comparative Example | 33 | 3.1 | 520 | 440 | 5000 | 15 | 10000 | 10 |
| Comparative Example | 34 | 3.7 | 520 | 440 | 5000 | 15 | 4900 | 8 |
| Comparative Example | 35 | 3.1 | 520 | 440 | 5000 | 15 | 5300 | 10 |
| Comparative Example | 36 | 3.0 | 600 | 520 | 5000 | 15 | 4900 | 10 |

The underlines mean that the value is out of the preferable manufacturing conditions.

TABLE 3

| Classification | No. | Intensity ratio of $Mg_{21}Zn_{25}$/η-Zn (—) | $Mg_2Sn$ phase | Performance: Surface corrosion resistance | Simulated cut edge corrosion resistance |
|---|---|---|---|---|---|
| Example | 1 | 1.0 | None | A | A |
| Example | 2 | 2.0 | Present | A | AA |
| Example | 3 | 5.0 | None | AA | AA |
| Example | 4 | 12.0 | None | AA | AAA |
| Example | 5 | 13.0 | None | AA | AAA |
| Example | 6 | 15.0 | None | AAA | AAA |
| Example | 7 | 15.0 | None | AAA | AAA |
| Example | 8 | 14.0 | None | AA | AAA |
| Example | 9 | 15.0 | Present | AA | AAA |

TABLE 3-continued

| Classification | No. | Intensity ratio of $Mg_{21}Zn_{25}$/η-Zn (—) | $Mg_2Sn$ phase | Performance: Surface corrosion resistance | Simulated cut edge corrosion resistance |
|---|---|---|---|---|---|
| Example | 10 | 18.0 | None | AAA | AAA |
| Example | 11 | 9.0 | None | AA | AA |
| Example | 12 | 8.0 | Present | AA | AAA |
| Example | 13 | 22.0 | None | AAA | AAA |
| Example | 14 | 21.0 | None | AAA | AAA |
| Example | 15 | 30.0 | None | AAA | AAA |
| Example | 16 | 22.0 | None | AAA | AAA |
| Example | 17 | 3.0 | None | A | AA |
| Example | 18 | 20.0 | None | AAA | AAA |

TABLE 3-continued

| Classification | No. | Intensity ratio of $Mg_{21}Zn_{25}$/η-Zn (—) | $Mg_2Sn$ phase | Performance: Surface corrosion resistance | Performance: Simulated cut edge corrosion resistance |
|---|---|---|---|---|---|
| Example | 19 | 26.0 | None | AAA | AAA |
| Example | 20 | 3.0 | None | A | A |
| Example | 21 | 3.0 | None | A | A |
| Example | 22 | 4.0 | None | A | A |
| Example | 23 | 26.0 | None | AAA | AAA |
| Example | 24 | 25.0 | None | AAA | AAA |
| Example | 25 | 26.0 | None | AAA | AAA |
| Example | 26 | 23.0 | None | AAA | AAA |
| Example | 27 | 26.0 | None | AAA | AAA |
| Comparative Example | 28 | 2.0 | None | B | A |
| Comparative Example | 29 | 3.0 | None | A | B |
| Comparative Example | 30 | 0.0 | None | B | B |
| Comparative Example | 31 | 8.0 | None | B | A |
| Comparative Example | 32 | 0.0 | None | A | B |
| Comparative Example | 33. | 0.3 | None | A | B |
| Comparative Example | 34 | 0.2 | None | A | B |
| Comparative Example | 35 | 0.3 | None | A | B |
| Comparative Example | 36 | 0.3 | None | B | B |

The underlines mean that the value is out of the scope of the present invention.

1 Plated steel sheet
11 Steel sheet
12 Plated layer

The invention claimed is:

1. A plated steel sheet comprising: a steel sheet; and a plated layer arranged on a surface of the steel sheet, wherein
the plated layer comprises, as a chemical composition, in terms of mass %,
Al: 10.0% to 25.0%,
Mg: 3.0% to 10.0%,
Fe: 0.01% to 2.00%,
Si: more than 0.00% and 2.00% or less,
at least one selected from a group consisting of following group A, group B, and group C, and
a remainder containing Zn and impurities, and
when the plated layer is subjected to grazing incidence X-ray diffraction measurement under conditions where Cu-Kα ray is used, an acceleration voltage as an X-ray output is 50 kV, and an X-ray incident angle against a surface of the plated layer is 1°, an X-ray diffraction intensity ratio between a (300) plane of a $Mg_{21}Zn_{25}$ phase and a (002) plane of an n-Zn phase (I ($Mg_{21}Zn_{25}$)/I (η-Zn)) is more than 0.3,
wherein,
[Group A] Ni: 0% to 1.000%,
[Group B] Ca: 0% to 0.05%, and
[Group C] 0% to 5.000% in total of at least one of
Sb: 0% to 0.50%,
Pb: 0% to 0.50%,
Cu: 0% to 1.00%,
Sn: 0% to 1.00%,
Ti: 0% to 1.00%,
Cr: 0% to 1.00%,
Nb: 0% to 1.00%,
Zr: 0% to 1.00%,
Mn: 0% to 1.00%,
Mo: 0% to 1.00%,
Ag: 0% to 1.00%,
Li: 0% to 1.00%,
La: 0% to 0.50%,
Ce: 0% to 0.50%,
B: 0% to 0.50%,
Y: 0% to 0.50%,
P: 0% to 0.50%,
Sr: 0% to 0.50%,
Co: 0% to 0.500%,
Bi: 0% to 0.500%,
In: 0% to 0.500%,
V: 0% to 0.500%, and
W: 0% to 0.500%.

2. The plated steel sheet according to claim 1, wherein
the plated layer comprises, as the chemical composition, in terms of mass %,
Mg: 4.5% to 10.0%, and
the X-ray diffraction intensity ratio (I ($Mg_{21}Zn_{25}$)/I (η-Zn)) is 1.0 or more.

3. The plated steel sheet according to claim 1, wherein
the plated layer comprises, as the chemical composition, in terms of mass %,
Mg: 4.5% er more to 10.0%, and
the X-ray diffraction intensity ratio (I ($Mg_{21}Zn_{25}$)/I (η-Zn)) is 5.0 or more.

4. The plated steel sheet according to claim 1, wherein
the plated layer comprises, as the chemical composition, in terms of mass %,
Mg: 4.5% er more to 10.0%, and
the X-ray diffraction intensity ratio (I ($Mg_{21}Zn_{25}$)/I (η-Zn)) is 10.0 or more.

5. The plated steel sheet according to claim 1, wherein
the plated layer comprises, as the chemical composition, in terms of mass %,
Sn: 0.05% to 0.5%, and
when the plated layer is subjected to X-ray diffraction measurement through θ-20 method, a $Mg_2Sn$ phase is detected in the plated layer.

6. The plated steel sheet according to claim 1, wherein the plated layer comprises, as the chemical composition, the group A.

7. The plated steel sheet according to claim 1, wherein the plated layer comprises, as the chemical composition, the group B.

8. The plated steel sheet according to claim 1, wherein the plated layer comprises, as the chemical composition, the group C.

* * * * *